United States Patent [19]

Peirce

[11] Patent Number: 4,687,448

[45] Date of Patent: Aug. 18, 1987

[54] OUTBOARD MOTOR TILT AND TRIM ADAPTOR APPARATUS AND SAFETY DEVICE

[76] Inventor: James G. Peirce, Rte. 1, Box 338, Madison Lake, Minn. 56063

[21] Appl. No.: 808,734

[22] Filed: Dec. 13, 1985

[51] Int. Cl.[4] ..... B63H 21/26

[52] U.S. Cl. ..... 440/53; 440/61; 248/642

[58] Field of Search ..... 440/53, 63, 65, 61, 440/56, 59, 900; 248/640–643

[56] References Cited

U.S. PATENT DOCUMENTS

| | | | |
|---|---|---|---|
| 2,966,876 | 1/1961 | MacWilliam | 115/41 |
| 2,997,014 | 8/1961 | Puckett | 115/17 |
| 3,053,489 | 9/1962 | Robinson et al. | 248/4 |
| 3,116,710 | 1/1964 | Cass | 440/61 |
| 3,250,240 | 5/1966 | Ziegler | 115/17 |
| 3,434,450 | 3/1969 | McCormick | 115/41 |
| 3,473,325 | 10/1969 | Vargo | 60/52 |
| 3,486,724 | 12/1969 | Adamski | 248/4 |
| 3,587,513 | 6/1971 | Stimatze | 115/41 |
| 3,653,270 | 4/1972 | Bergstedt | 440/59 |
| 4,302,195 | 11/1981 | Bryant | 248/640 |
| 4,354,848 | 10/1982 | Hall et al. | 248/642 |
| 4,545,770 | 10/1985 | Ferguson | 440/63 |

*Primary Examiner*—Joseph F. Peters, Jr.
*Assistant Examiner*—Edwin L. Swinehart
*Attorney, Agent, or Firm*—Lawrence M. Nawrocki

[57] ABSTRACT

The invention of the present document is an adaptor device (10) for effecting tilting and trimming of an outboard motor (34) mounted to the transom (36) of a boat (38). The device (10) concurrently provides a feature wherein, if the motor (34) engages submerged debris, it is kicked upwardly and rearwardly so that the boat (38) can pass over the debris with minimal, if any, damage. The device (10) includes a base (12) to which are mounted a pair of telescoping cylinders (26). The cylinders include first portions (28) fixedly mounted at the base (12) and second portions (30) which are able to be extended with respect to the first portions (28). The extensible portions (30) pivotally mount transmission links (32) which are, in turn, pivotally mated, at opposite ends from the ends by which they are mounted to the cylinders (26) to the motor (34). The base (12) can be suspended from the transom (36) of the boat (38) by means of a pair of suspension arms (52).

6 Claims, 9 Drawing Figures

OUTBOARD MOTOR TILT AND TRIM ADAPTOR APPARATUS AND SAFETY DEVICE

TECHNICAL FIELD

The present invention is related broadly to the field of watercraft utilizing outboard motors. More narrowly, however, the invention deals with a device for adapting the outboard motor mounting structure to serve a tilt and trim function concurrently with a safety function wherein the motor is automatically tilted upwardly upon engagement with an underwater obstacle.

BACKGROUND OF THE INVENTION

Over the past years, recreational boating has become an important and often-engaged-in pastime of many people throughout the world. Depending upon the ability to make a significant investment, participants in this pastime can either rent or purchase a boat for use for waterskiing and other water activities.

For those who purchase their own boat, a number of choices are available to them. One of the choices is whether to buy a boat employing an inboard motor or an outboard motor. Again, the ability to make financial outlays appears to be the key factor entering into the decision.

The former type of power configuration is one wherein the motor is a permanent fixture of the craft of which it is a part. The latter configuration employs a detachable motor securable to the transom or stern sheet of the boat. Various types of securing means can be and are employed for effecting mounting of the motor. Typically, mounting is effected by engaging a member of a motor-mounting rack with the outwardly facing surface of the transom. An arm extends over the transom and inboard thereof. The arm carries a screw-down type clamp which can be manipulated to be brought into engagement with the inwardly facing side of the transom. Appropriate pressure can be applied to the screw-down type clamp to securely hold the motor in place.

An outboard motor is, typically, disposed for pivoting about an axis defined by a shaft of the mounting rack. Such pivotal mounting allows the motor to be tilted upwardly when, for example, the boat to which it is mounted is taken out of the water and is to be transported on a trailer. Such tilting involves fairly significant angular changes.

Another purpose in mounting an outboard motor pivotally with respect to the transom of the craft with which it is to be used is to enable "trimming" of the motor. Trimming is a process by which fine angular adjustments are made to the motor while the propeller is in the water in order to maximize the efficiency of operation of the motor. The static and dynamic positioning of a motor will vary depending upon the length of the craft, its center of gravity, etc. As can be seen, therefore, when an outboard motor is used with different water vehicles, it will have to be trimmed differently.

Manufacturers of outboard motors typically provide structure to allow trimming of the motor depending upon the craft with which it is to be used. Most frequently, this structure comprises an arcuate bracket extending rearwardly and upwardly from a location on the motor-mounting rack. The bracket has, formed therein, a plurality of arcuately spaced apertures. The motor itself can be provided with an aperture registrable with each of those formed in the bracket. Depending upon the desired location of the motor with respect to the bracket, the aperture of the motor can be brought into registration with a desired aperture in the bracket. A pin can, thereafter, be inserted to maintain the desired motor orientation.

While motor manufacturers typically employ the trim method described hereinbefore, various companies have devised "tilt and trim" devices to accomplish both drastic changes in angle of tilt of the motor and to finely trim the angle of the motor when it is in the water. A number of these devices employ hydraulic or pneumatic cylinders utilizing a reciprocable piston. The base of the cylinder is mounted to the transom of the boat with which the motor is used, and the distal end of the telescoping portion is affixed at the motor. By selectively extending and retracting the piston, the motor is tilted about the axis with respect to which it pivots. As can be seen, such a device enables both large and small angular changes to be made to the relative positioning of the motor with respect to the transom.

A problem that can be encountered during boating activity is one wherein the downwardly depending motor encounters submerged debris or a shallow bottom. When such an occurrence takes place, it is desirable that the motor be automatically pivoted upwardly and rearwardly with respect to the transom. This is so for a number of reasons. First, if the motor remained in place relative to the boat, the hydrodynamic characteristics of the boat could become drastically altered. Second, by allowing the motor to so pivot, the likelihood of serious damage being occasioned upon the motor is minimized.

Prior art structures have sought to deal with this problem. Virtually universally, however, the focus of the solution has been providing a hydraulic or pneumatic bypass to permit pivoting when a sudden increase in pressure is brought to bear upon the motor. As a result, when the motor is pivoted because of engagement with submerged debris or a shallow bottom, the mechanism often need be reset before continuing normal craft operation. Certainly, a device both simple in operation and automatically resetable after the motor is pivoted upwardly would be a significant advance in the art.

The present invention is one which addresses the problems of the prior art, provides solutions to those problems, and accommodates the desirable features dictated by the art. It is a simple-operating and exclusively-mechanical "tilt and trim" mechanism significantly improved over structures of the prior art.

SUMMARY OF THE INVENTION

The present invention is an adaptor device for effecting tilting and trimming of an outboard motor pivotally mounted to a boat for positioning rearwardly of the transom of the boat. The device concurrently functions to serve as a safety device to permit the motor to kick upwardly and rearwardly when it is engaged by a relatively immobile underwater obstacle. The device includes a base which is mountable outboard of the transom for engagement therewith. When the base is mounted in such a position, it is disposed for pivoting relative to the transom. A telescoping cylinder is carried by the base so that, when the base is mounted in position proximate the boat's transom, the cylinder extends rearwardly therefrom. Means are provided for selectively adjusting the degree of telescoping of the cylinder. A distal end of the cylinder pivotally mounts a transmission link at its first end. A second end of the link, in turn, is pivotally mounted at a location at the motor.

Typically, the purchase of an outboard motor includes a mounting rack by which it is affixed to the transom of a boat with which it is to be used. Many of such mounting racks employ an arcuate bracket which extends, when the rack is affixed to a boat transom, rearwardly and upwardly from the transom. The bracket is afforded a measure of arcuity so that, as the motor is pivoted about an axis proximate an upper end of the transom, a common point on the motor will pass along the bracket. The bracket can, thereby, be provided with a plurality of apertures, each of which will be brought into registration with an aperture at the motor as the motor is pivoted. The motor can thus be "trimmed" to achieve maximum operating efficiency. A trim locking pin can be employed to lock the motor into a desired relative position with respect to the bracket. The pin can be inserted through the aperture at the motor and the hole in the bracket registered with that aperture.

When a mounting rack having such a bracket is used to mount the motor, the bracket can also function to mount the present invention. An arm or arms, pivotally mounted to the base for rotation about a common axis, when plural arms are provided, can be provided with apertures registrable with one of the bracket holes. Rather than locking the motor to the bracket, the trim locking pin can be employed to affix the arm or arms to the bracket. The base will, thereby, be suspended from the mounting rack bracket.

Because the link is pivotable with respect to both the motor and the cylinder by which it is carried, operation of the motor to turn the propeller will allow the motor to tilt downwardly about the axis with respect to which it pivots. Such movement will, effectively, draw the link behind the motor. The motor will, however, be precluded from continued movement toward the transom by the fixed length transmission link and the telescoping cylinder carried by the device base. At a point as the motor, in operation, swings downwardly and forwardly, the base will engage the transom to preclude further motor movement. The effect of propeller rotation will, at that point, be to propel the boat through the water.

Plural transmission links and corresponding cylinders, one assembly on either side of the motor, can be provided, and, as will be seen in view of this disclosure, operation of the motor will have the effect of "pulling" these links rather than "pushing" them. The transmission links, in turn, will draw the pistons and the base by which they are carried forwardly. The application of forward force to the transmission links will tend, in view of the geometry of the overall adaptor invention, to make parallel, longitudinal axes of the links and their respective pistons. As parallelism is achieved, the transmission links will effectively preclude rearwardly and upwardly pivoting of the motor.

Should an underwater obstacle be engaged by the motor, however, a degree of rearward movement permitted by the swinging of the suspension arm or arms away from the transom will be permitted. As the base moves away from the transom, the longitudinal axes of the transmission links and their respective pistons will be forced out of parallel. The links will, thereafter, be permitted to pivot about points of attachment to their respective pistons until they are oriented so that they extend rearwardly from those points. This action will, of course, tend to occur as long as the motor is in engagement with the underwater obstacle. The preferred embodiment of the invention envisions cylinders and transmission links sufficiently long to allow the motor to pivot rearwardly and upwardly a distance until it is above the keel of the boat.

Once the boat has cleared the obstacle, the weight of the motor and the continued impulse generated by rotation of the propeller will, again, orient the transmission links so that they extend forwardly from their points of attachment to their respective cylinders. The axes of the links and their respective cylinders will, automatically, tend to become aligned in a parallel relationship.

The base, in the preferred embodiment, carries a motor having a rotatable shaft. In this embodiment, the base also carries a shaft extending internally within each cylinder. A telescoping portion of the cylinder has an internally threaded circularly cylindrical wall, and its corresponding shaft has an externally threaded circularly cylindrical wall operatively received within the telescoping portion of the cylinder. The shafts are rotatable, and means are provided for transmitting the rotation of the motor shaft to the shafts internal to the cylinders. As the motor is made to rotate in a first direction, therefore, the telescoping portions of the cylinders will be extended. As the motor shaft is made to rotate in the opposite direction, therefore, the telescoping portions of the cylinders will be retracted.

The present invention is, therefore, an improved device for effecting tilting and trimming of an outboard motor. The device can be exclusively mechanical without any hydraulic or pneumatic operating parts, as is illustrated in the preferred embodiment. While serving a trimming and tilting function, the device also affords a safety feature whereby the motor will be permitted to kick upwardly and rearwardly when it engages an underwater obstacle. More specific features and advantages obtained in view of the those features will become apparent with reference to the DETAILED DESCRIPTION OF THE INVENTION, appended claims, and accompanying drawing figures.

DETAILED DESCRIPTION OF THE INVENTION

Figure 2:
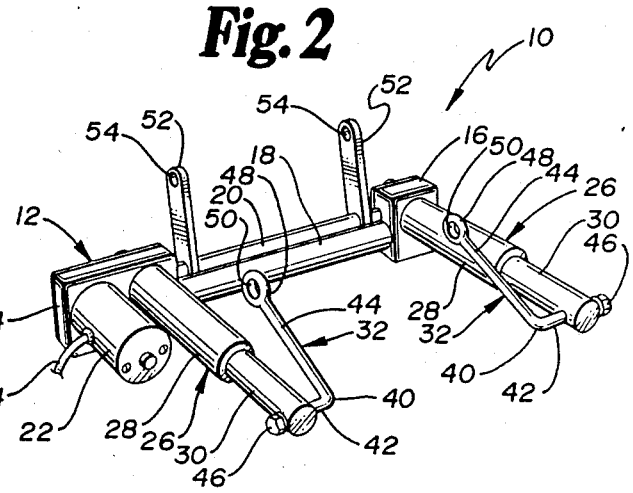
FIG. 2 is a perspective view of the invention in a dismounted configuration.

Referring now to the drawings wherein like reference numerals denote like elements throughout the several views, FIG. 2 illustrates a device 10 in accordance with the present invention. The device 10 includes a base 12 having cylinder support housings 14, 16 at opposite ends of the base 12 interconnected by a hollow conduit 18 and a rod 20, having an axis of elongation generally parallel to that of the hollow conduit 18, spaced from the conduit 18. As seen in that figure, one of the cylinder support housings 14 is larger than the other 16, and a reversible motor 22 is mounted to the larger of the housings 14. The motor 22 has an electrical actuation cable 24 by which motor actuation and direction of motor rotation are controlled.

Each cylinder support housing 14, 16 mounts a telescoping cylinder 26 which includes a first portion 28, fixedly attached to its respective housing, and a second, piston portion 30, which telescopes relative to the first portion 28. Telescoping of the cylinders 26 can be accomplished by means of structure and in a manner as will be discussed hereinafter.

A link 32, by which motive force generated by an outboard motor 34 is transmitted to the device 10 and, in turn, to the transom 36 of a boat 38 to which the motor 34 is attached, and by which telescoping of the cylinders 26 is transmitted to the motor 34 to tilt the motor 34 about an axis with respect to which it is pivotally mounted to the boat 38, is associated with each cylinder 26. One of the links 32 is pivotally mounted to the distal end of the reciprocable portion 30 of its respective cylinder 26. Attachment can be effectuated in any appropriate manner.

The figures illustrate the preferred embodiment as utilizing links 32 formed from bar stock and bent at a 90 degree angle as at 40 to form short and long legs 42, 44. The short leg 42 of each link 32 is passed through an aperture extending through the distal end of the telescoping portion 30 of the cylinder 26 in an orientation generally parallel to the hollow conduit 18 of the device base 12. The links 32 can be maintained in place secured to the telescoping pistons 30 of their respective cylinders 26 by providing the ends of the short legs 42 protruding from the apertures in the pistons 26 with external threading (not shown). Cap nuts 46 can be secured onto this threading in order to hold the links 32 to the cylinders 26. As can be seen, with the short legs 42 free to rotate within the apertures in which they are received, the long legs 44 of the links 32 are able to be pivoted about the axes of the links' respective short legs 42.

Ends of the links 32 opposite those comprising the short legs 42 are provided with enlargements 48 having eyes formed therethrough. The axes of the eyes 50 are generally parallel to the axis of elongation of the hollow conduit 18 of the base 12. As will be seen hereinafter, these eyes 50 function to facilitate attachment of the links 32 at the motor 34.

FIG. 2 also illustrates a pair of arms 52 pivotally mounted to the shaft 20 whose axis is parallel to the hollow conduit 18. Ends of these arms 52 opposite those by which they are mounted to the shaft 20 are also provided with eyes 54 for securing to appropriate structure so that the base 12 can be mounted to the boat 38 and made to engage the transom 36 thereof.

Figure 1:
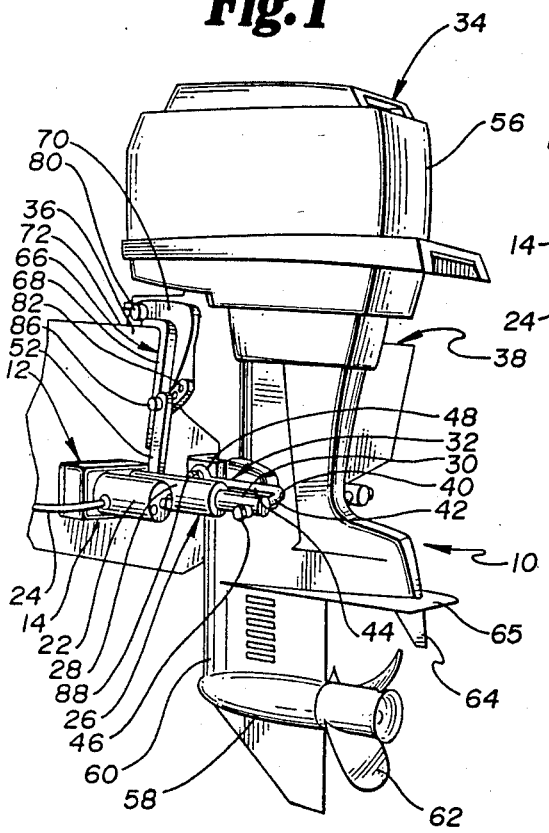
FIG. 1 is a perspective view of the invention as installed for use with an outboard motor mounted on the transom of a boat.
Figure 4:
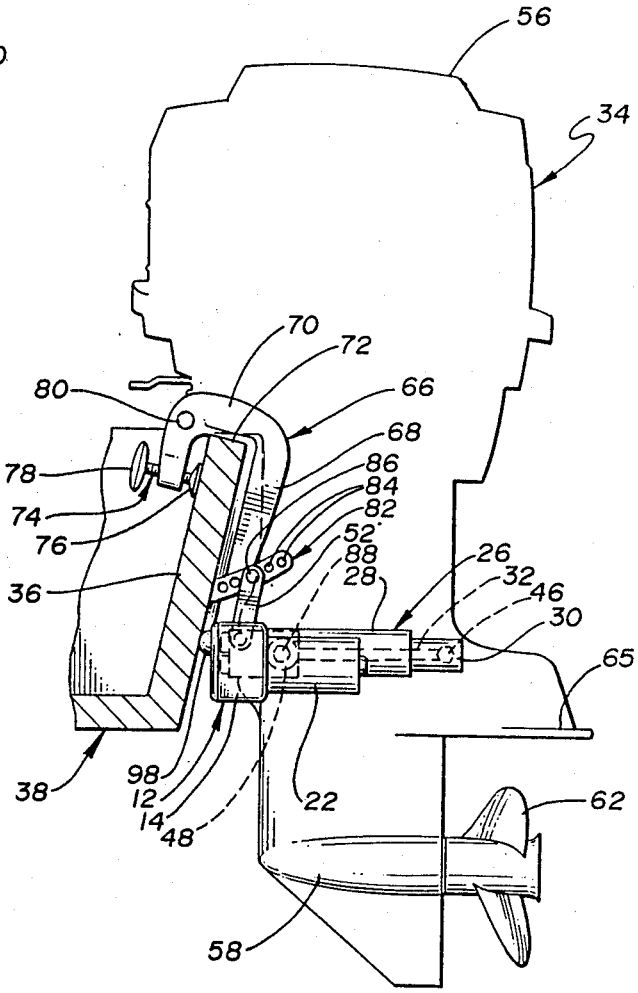
FIG. 4 is a left side functional diagram showing the motor position as it operates to propel the boat to which it is mounted through the water.

FIGS. 1 and 4 illustrate a typical outboard motor 34 as mounted to the transom 36 of a boat 38 with which it is to be used. The motor 34 includes an engine housing 56, a propeller shaft casing 58, a vertical strut 60 spacing the propeller shaft casing 58 from the housing 56, a propeller 62 mounted to its shaft, and vertical and horizontal stabilizers 64,66.

As best seen in FIG. 4 the engine 34 is mounted to the transom 36 of the boat by means of a mounting rack 66. Typically, such a rack 66 includes a frame 68 which engages the outwardly facing surface of the transom 36, and at least one arm 70 extending upwardly and over the upper edge 72 of the transom 36. The arm 70, thereafter, extends downwardly inboard of the transom 36 and has an aperture therein for receiving a clamp-down screw 74 therein. The screw 74 typically has a flange 76 at its distal end for engagement of the inwardly facing surface of the transom 36. Manually graspable handle means 78 can be provided at the opposite end of the screw 74 to facilitate tightening of the screw 74 to tightly secure the mounting rack 66 to the transom 36.

The rack 66, in turn, carries the engine 34. The rack 66 is provided with a generally horizontally extending shaft 80 proximate its upper extremities for pivotally carrying the engine 34. This shaft 80 defines an axis about which the engine 34 can be pivoted.

While the boat 38 having the motor 34 attached thereto is being transported, the motor 34 would typically be pivoted upwardly and rearwardly with respect to the transom 36. Depending upon the engine and mounting rack manufacturer, means (not shown) can be provided for locking the motor 34 in an upwardly pivoted position.

Typical mounting racks include a bracket 82 or pair of brackets extending, when the rack 66 is attached to the transom 36 of the boat 38, rearwardly and upwardly from the frame 68 of the rack 66 which engages the outwardly facing surface of the transom 36. The motor strut 60 can be provided with an aperture and the bracket 82 with a plurality of apertures 84 spaced arcuately therealong so that the motor strut aperture, as the motor 34 is pivoted, can be registered with each of the apertures 84 of the bracket 82. The angle of the motor 34 relative to the transom 36 can, therefore, be varied when the propeller 62 is in the water to maximize efficiency and performance of the motor 34.

A trim locking pin 86, generally provided by the manufacturer, can be inserted through the aperture at the motor strut and the particular hole or holes 84 in the bracket or brackets 82 with which the aperture is registered. If trimming is necessary, the trim locking pin 86 merely need be removed, the motor 34 pivoted about the shaft 80 about which it rotates to register the strut aperture with the appropriate bracket hole 84 to a different hole realignment, and the pin 86 reinserted.

The present invention contemplates removal of the trim locking pin 86 and insertion of the present inventive device 10 operatively between the bracket 82 and the motor 34. A device in accordance with the present invention, it is envisioned, would utilize the trim locking pin 86 provided by the manufacturer to secure the device 10 to the bracket or brackets 82. The eyes 54 in the distal ends of the arms 52 would be made to register with a desired hole 84 in the bracket or brackets 82, and the trim locking pin 86 be reinserted. The motor 34 is, of course, not locked into a position at the bracket 82.

The enlarged portions 48 of the transmission links 32 are, similarly, pivotally mated to the motor 34. This can be accomplished by inserting bolts 88 through the eyes 50 formed in the links 32 and into shock mounts (if such mounts are provided in an appropriate location on the engine 34). If such mounts are not available, the use of a special bracket 90 can accomplish the same purpose.

Figure 3:
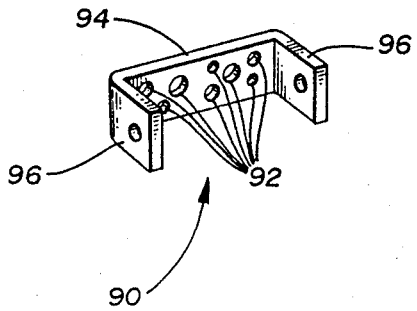
FIG. 3 is a perspective view of an adaptor bracket by which transmission links of the device can be pivotally mated to the motor.

FIG. 3 illustrates such an adaptor bracket 90. The bracket 90 would, typically, be generally U-shaped and have a plurality of holes 92 formed in the base 94 thereof to allow fixation of the bracket 90 to the engine 34. Each of a pair of arms 96 would depend along the side of the engine 34 to receive the bolts 88 which have been passed through the eyes 50 of the corresponding transmission links 32.

The present invention, therefore, functions to accomplish tilting and trimming of the engine 34 in a non-manual fashion. The tilting and trimming function will now be discussed with particular reference to FIGS. 4 and 5. As seen in those figures and FIG. 2, the base 12 of the device 10 can be provided with bumpers 98, one being mounted on the forwardly facing side of each cylinder mount housing 14, 16. These bumpers 98 enable engagement of the device base 12 with the boat's transom 36 without causing significant damage to either the adaptor device 10 or the transom 36.

When the motor 34 is operating to rotate the propeller 62, the engine 34, in its entirety, will be urged forward. The upper portion of the engine 34 is, of course, fixedly mounted for pivoting about the mounting shaft 80. The propeller 62 being proximate the bottom of the engine 34, rotation of the propeller 62 will tend to pivot the engine assembly downwardly and forwardly about the shaft 80. Such movement will draw the linkages 32 forwardly while they protrude rearwardly from the points of attachment to the motor 34. Similarly, the linkages 32 will pull their respective cylinders 26 forwardly to urge the base 12 of the device 10 into engagement with the boat's transom 36. The tendency of the motor 34 to move as far forward as possible relative to the cylinders 26 will have the effect of tending to make parallel the axes of elongation of the cylinders 26 and their respective links 32. This orientation is seen in FIGS. 1 and 4.

Figure 5:
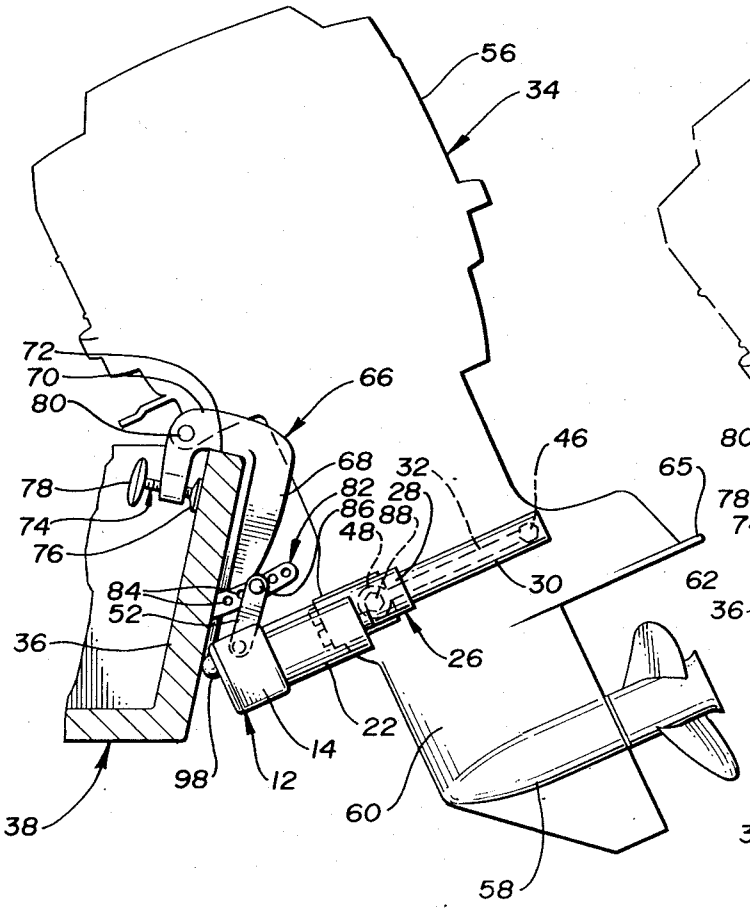
FIG. 5 is a left side functional diagram showing volitional operation of the tilt and trim adaptor mechanism to tilt the motor upwardly.
Figure 7:
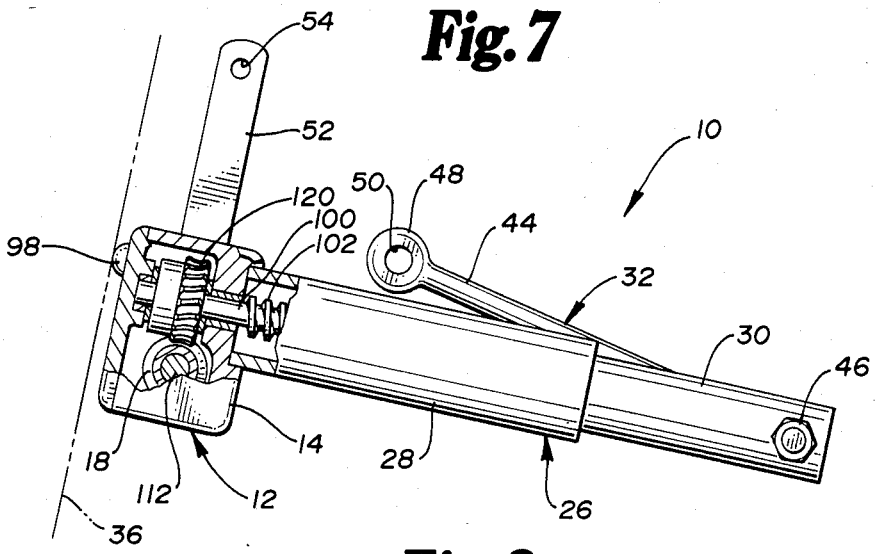
FIG. 7 is a side elevational view of the invention, alone, as it would be positioned in engagement with the transom of a boat, some portions of the structure being broken away.
Figure 8:
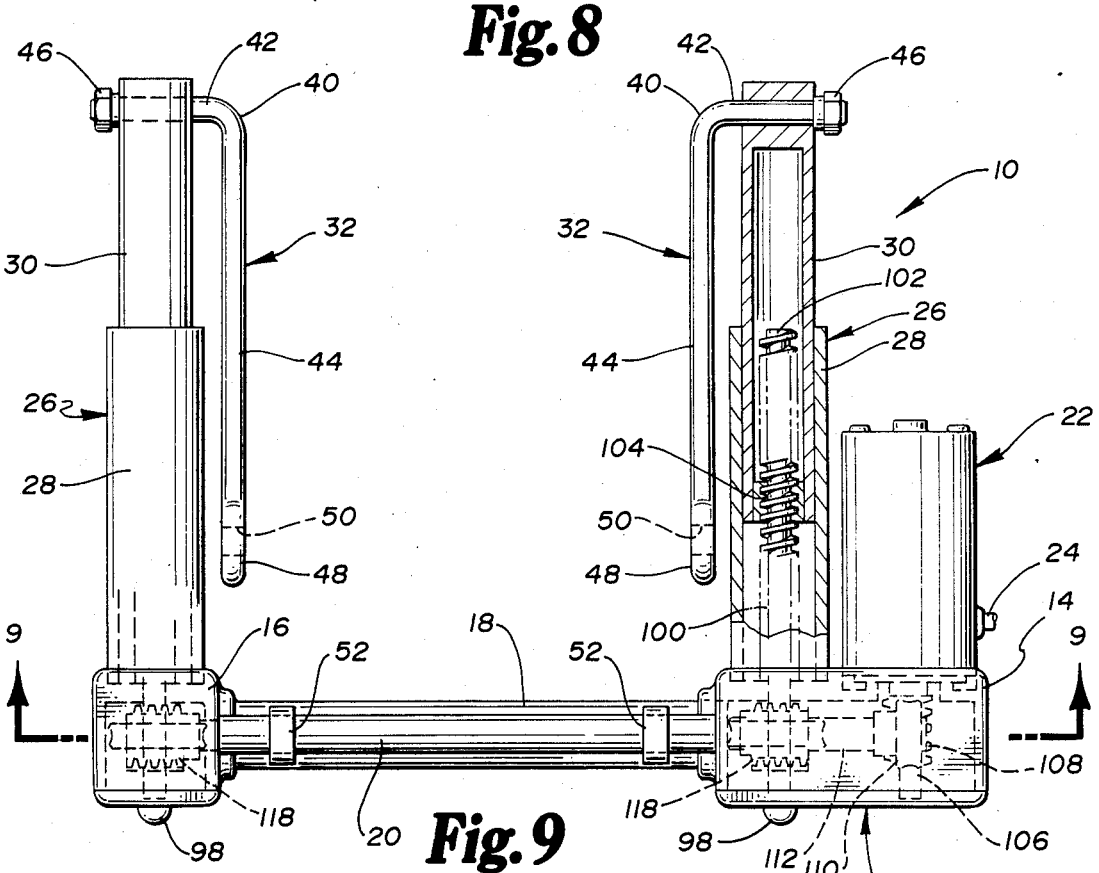
FIG. 8 is a bottom plan view of the device illustrated in FIG. 7, some portions thereof being broken away.
Figure 9:
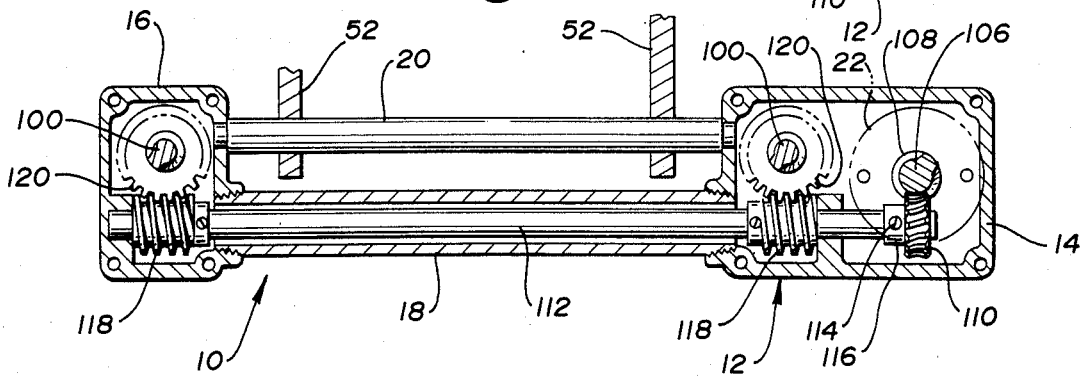
FIG. 9 is a sectional view taken generally along the line 9—9 of FIG. 8.

Should it be necessary to trim the motor 34 or tilt it up out of the water, the pistons 30 of the telescoping cylinders 26 can be made to extend as to a position as seen in FIG. 5. While the invention, in its broadest sense, does not contemplate a specific structure for effecting extension, it is envisioned that the preferred embodiment would be totally mechanical in operation (with the exception of piston drive motor 22 operation) so that pneumatic and hydraulic devices would not be necessary. FIGS. 7, 8, and 9 illustrate a contemplated structure for effecting extension and retraction of the cylinder pistons 30.

Each cylinder 26 has, running internally therewithin, a rotatable shaft 100 which extends from the base 12. Each shaft 100, at a location therealong which is axially coextensive with a portion of the telescoping member 30 of the cylinder 26, has flighting 102 formed in a generally circularly cylindrical, outer surface thereof. Similarly, an internal, generally circularly cylindrical wall of the telescoping member has female flighting 104 formed therein to receive the axially coextensive portion of the shaft 100. As the shaft 100 is made to rotate, the male flighting 102 thereof will drive the female flighting 104 to either extend or retract the telescoping portion 30 of the cylinder 26, depending upon the direction of rotation of the shaft 100.

Rotation of the piston drive motor shaft 106 can be translated into rotation of the shaft 100 extending from the base 12, in any appropriate manner. FIG. 8 illustrates the motor shaft 106 as having a worm gear 108 mounted thereto. The worm gear 108, in turn, cooperates with a helical gear 110, secured to a shaft 112 extending substantially the length of the base 12 by means of a set screw 114 passing through a collar 116 of the gear 110 and into the shaft 112, in order to impart rotation to the shaft 112.

Proximate the end of each of the shafts 100 extending into the cylinders 26, this common shaft 112 has, mounted thereto, a worm gear 118. As seen in FIG. 7, the innermost end of each cylinder shaft 100 is provided with a helical gear 120. Each of these helical gears 120, in turn, cooperates with its respective worm gear 118 on the common shaft 112 to transfer the rotation of the common shaft 112 to the shafts 100 extending from the base 12 into the cylinders 26. It will be understood that the direction of flighting and configuration of the various gears will be such that rotation of the motor shaft 106 will simultaneously effect common extension or retraction of the cylinder telescoping portions 30.

As the cylinders 26 are telescoped so that the axially extensible portions 30 thereof are made to move outwardly, the transmission links 32 will remain in an orientation extending forwardly from their points of attachment to the distal ends of their respective cylinder extensible portions 30. This is so since the force exerted by the cylinders 26 upon the engine 34 continues to be in a direction opposite that exerted by the engine 34 upon the cylinders 26. In the typical instance of when an operator desires to tilt the motor 34 up to a transport position, the weight of the engine 34 will effect this counter application of forces.

Figure 6:
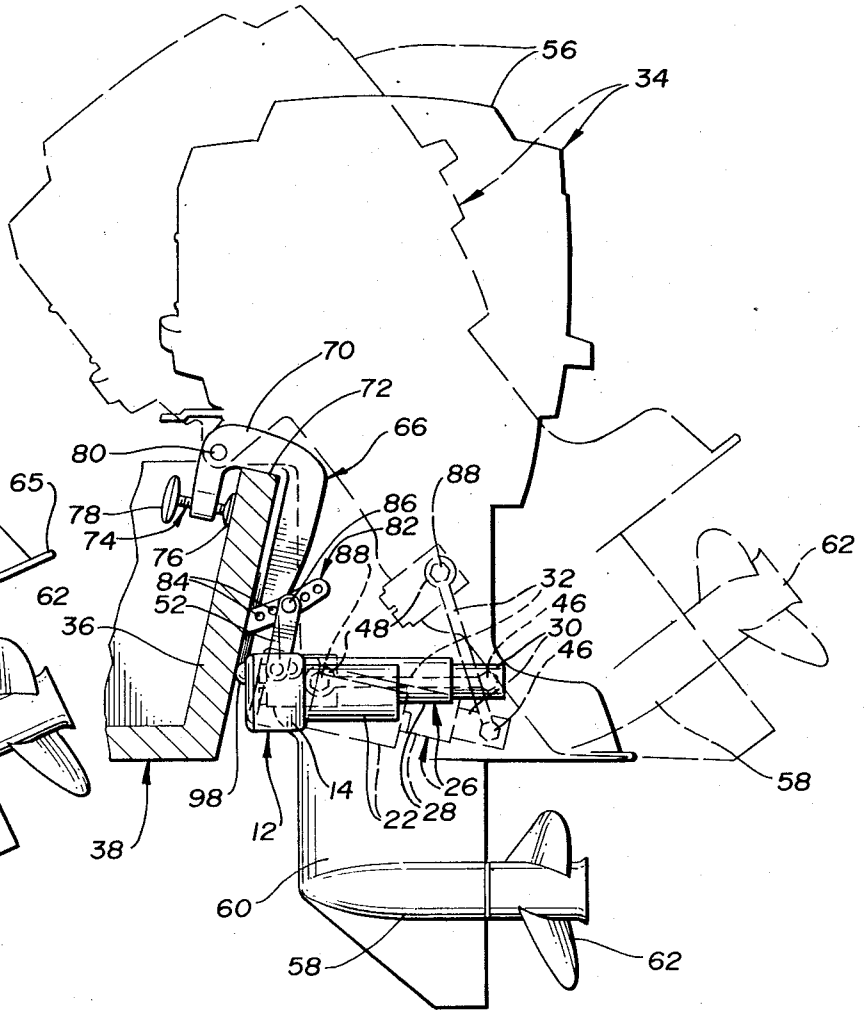
FIG. 6 is a left side functional diagram showing operation of the device to allow the motor to be kicked upwardly and rearwardly when it engages an underwater obstacle.

As previously discussed, if the engine strut 60 or a blade of the propeller 62 encounters an underwater obstacle, the present mechanism will permit the engine 34 to kick rearwardly and upwardly as a safety feature. Such functioning will be described with reference to FIGS. 4 and 6.

As previously indicated, as the boat 38 is moving through the water, the configuration and orientation of the various parts of the device 10 will be as illustrated in FIG. 4. The bumpers 98 of the base 12 will be in engagement with the transom 36, as a result of the weight of the engine 34 and the propulsive force exerted thereby. The longitudinal axes of the cylinders 26 and the transmission links 32 will also tend to be in a parallel disposition. Consequently, rearward movement of the engine 34, if any were to be occasioned, would be because of the adaptor device base suspension arms 52 swinging rearwardly to disengage the base bumpers 98 from the transom 36. The ability of such rearward movement to occur would, therefore, be extremely limited.

Should the engine vertical strut 60, for example, engage a piece of floating debris submerged beneath the water, the first movement imparted to the engine 34 and adaptor device 10 would be the swinging of the base 12 rearwardly and out of engagement with the transom 36. If the force exerted upon the vertical strut 60 by the debris continued to be sufficient, the rearward swinging would be maximized and to a point at which the longitudinal axes of the cylinders 26 and transmission links 32 would become out of parallel. If the force continued to be maintained at a sufficient level, it would function to rotate the engine 34 rearwardly and upwardly about shaft 80, the transmission links 32 pivoting about the points at which the first ends thereof are mounted to their respective cylinders 26 so the links 32 would be disposed rearwardly of those pivot points. This would, in effect, lengthen the adaptor device 10 so that the engine 34 could be pivoted so that its lowermost extremity would be above the keel of the boat 38. As a result, the boat 38 could pass clear of the debris.

Once the debris were passed, the weight of the engine 34 would cause it to again be lowered. Once the propeller 62 entered the water, additional force would impel the engine 34 back to its normal operating position as illustrated in FIG. 4.

Numerous characteristics and advantages of the invention for which this application has been submitted have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Apparatus for permitting an outboard motor, pivotally mounted with respect to the transom of a boat, to pivot upwardly and rearwardly when it encounters a submerged obstacle as the boat moves through the water, comprising:

(a) a base;

(b) an arm for suspending said base outboard of the transom, said arm being pivotally mounted, at one end thereof, with respect to the transom, and being pivotally attached, at an opposite end thereof, to said base, wherein said base is able to be swung toward, and engage, the transom and, when in engagement with the transom, is able to pivot relative thereto;

(c) an extension, having a distal end, carried by said base, said distal end, during operation of the boat, projecting rearwardly from the transom; and (d) a transmission link pivotally connected, by a first end thereof, to said distal end of said extension, and, by a second end thereof, to the motor;

(e) wherein, when the motor operates to propel the boat through the water, said transmission link and extension are pivoted, relative to the motor and each other, such that said transmission link extends rearwardly from a location at which it is pivotally connected to the motor and generally parallel to, and coextensive with, said extension, and said base is swung into engagement with the transom; and (f) wherein, when a submerged obstacle is encountered as the boat moves through the water, said base is swung out of engagement with the transom causing said extension to become non-parallel with said transmission link, said transmission link pivoting, thereafter, as a result of continued rearward exertion of force upon the motor by the submerged obstacle, such that is extends forwardly from the location at which it is pivotally connected to the motor to allow the motor to pivot upwardly and rearwardly relative to the transom.

2. Apparatus in accordance with claim 1 wherein said extension comprises a telescoping cylinder.

3. Apparatus in accordance with claim 2 further comprising means for selectively adjusting the degree of telescoping of the cylinder.

4. Apparatus in accordance with claim 3 wherein the motor is mounted to the boat by a mounting rack having a bracket extending rearwardly from the transom of the boat, the bracket having at least one hole, for receiving a trim locking pin, formed therein; and wherein said arm is able to be suspended from the bracket by registering an aperture in said arm with a bracket hole and passing the trim locking pin therethrough.

5. Apparatus in accordance with claim 3 wherein said cylinder includes a first member fixed at said base and a second member, carried by said first member, disposed for axial movement relative thereto, and wherein said adjusting means further comprises:

(a) a motor carried by said base, said motor having a rotatably actuable shaft;

(b) a shaft extending from said base internally within said cylinder, said shaft extending from said base being rotatably disposed relative thereto and having an externally threaded, generally circularly cylindrical surface operatively received within an internally threaded, generally circularly cylindrical surface of said second cylinder member; wherein, as said shaft extending from said base is made to rotate, said second cylinder member will telescope relative to said first member;

(c) means for translating rotation of said motor shaft into rotation of said shaft extending from said base; and (d) means for selectively actuating said motor to rotate said motor shaft.

6. Apparatus for adjusting the tilt and trim of an outboard motor pivotally mounted with respect the transom of a boat by a mounting rack having a bracket extending rearwardly from the transom of the boat, the bracket having at least one hole, for receiving a trim locking pin, formed therein, and for simultaneously permitting the motor to pivot upwardly and rearwardly when it encounters a submerged obstacle as the boat moves through the water, comprising:

(a) a base suspendable outboard of the transom for engagement therewith and disposed for pivoting relative thereto;

(b) a pair of telescoping cylinders carried by said base, each projecting rearwardly therefrom on one of opposite sides of the motor;

(c) means for selectively adjusting the degree of telescoping of said cylinders;

(d) a pair of transmission links, each pivotally connected, by a first of its ends, to a corresponding cylinder proximate a distal end thereof, and, by a second of its ends, to the motor; and (e) a pair of arms for suspending said base proximate the transom, each of said arms having a first end by which it is pivotally attached to said base, and a second end having an aperture, registrable with a bracket hole, formed therein; wherein said arms are able to be suspended from the bracket by registering said apertures in said arms with the bracket hole and passing the trim locking pin therethrough.

* * * * *